United States Patent [19]

Sigg

[11] Patent Number: 4,912,884

[45] Date of Patent: Apr. 3, 1990

[54] AUTOMATIC CALIBRATION EQUIPMENT FOR PLANAR GRINDING MACHINES

[75] Inventor: Hans Sigg, Neuchâtel, Switzerland

[73] Assignee: Meseltron S.A., Switzerland

[21] Appl. No.: 264,565

[22] Filed: Oct. 31, 1988

[30] Foreign Application Priority Data

Nov. 2, 1987 [FR] France ..... 87 15263

[51] Int. Cl.[4] ..... B24B 49/00

[52] U.S. Cl. ..... 51/165.75; 51/165.77

[58] Field of Search ..... 51/165.77, 165.71, 165.75, 51/165.76, 165.87, 91 R, 92 R, 121, 122, 143

[56] References Cited

U.S. PATENT DOCUMENTS 3,704,557 12/1972 Peonski ..... 51/165.75
3,862,517 1/1975 Porter, Jr. ..... 51/165.75
4,538,449 9/1985 Wegmann et al. ..... 73/37.9

*Primary Examiner*—Judy Hartman
*Assistant Examiner*—Maurina Rachuba
*Attorney, Agent, or Firm*—Pollock, Vande Sande & Priddy

[57] ABSTRACT

Automatic calibration equipment for planar grinding machines comprises a measuring head (12) fixed to a table (4) of the associated grinding machine for measuring the distance between this table and the grinding wheel (6), and an electronic measuring and control apparatus (14) for receiving the output signal of the measuring head and producing signals controlling the forward and rearward movement of the grinding wheel. The measuring head comprises a pneumatic circuit with a first branch of very low internal volume provided with an inlet nozzle and a measurement outlet nozzle (48) oriented to blow towards the edge of the grinding wheel, a second branch provided with an inlet nozzle and a reference nozzle, means for connecting the inlet nozzles of these branches to an installation (18) delivering compressed air at regulated pressure, and a pressure-differential transducer with a semi-conducting element for detecting the difference between the pressures in the two branches.

9 Claims, 2 Drawing Sheets

AUTOMATIC CALIBRATION EQUIPMENT FOR PLANAR GRINDING MACHINES

BACKGROUND OF INVENTION

The present invention concerns automatic calibration equipment for planar grinding machines which conventionally comprise a horizontal table for carrying workpieces and a grinding wheel arranged above this table, the grinding wheel having an edge for machining the workpieces and being movable forward and backward for coming into contact with and moving away from the workpieces.

More precisely the invention concerns automatic calibration equipment which comprises a measuring head fixed to the table of the grinding machine for producing during machining of the workpieces an electric output signal that passes through an extreme value each time the grinding wheel passes above it, this extreme value being a function of the distance which separates the grinding wheel from the table at that instant, means for memorizing values which correspond to at least certain of the values taken by the output signal of the measuring head and means for producing control signals controlling the forward and backward movement of the grinding wheel when the memorized values correspond to reference values.

In known equipment of this kind the measuring head is mechanical, comprising a measuring feeler that touches the edge of the grinding wheel and exerts thereon a given measuring force produced by a spring, and an inductive or capacitative transducer producing the aforementioned electric output signal in response to movements of the feeler.

Because of this the known equipment has several drawbacks :

Firstly, the edge of the grinding wheel is worn irregularly by the measuring feeler and correspondingly the feeler is worn by the grinding wheel, which inevitably produces measurement errors that increase with time.

Secondly, as the grinding wheel turns very rapidly, grains which are detached therefrom and chips off the workpieces are projected and often hit the feeler and make it oscillate and sometimes resonate; since the memorized values, which in this instance are minimum values, are as a result less than what they should be, the machine may prematurely be caused to proceed from one phase of the grinding operation to another and the grinding wheel may be caused to retract before the workpieces have reached their exact final dimensions. This is all the more true as it is usual for the measurement feeler to be so arranged as to exert on the grinding wheel only a weak measuring force whereby the mutual wear of the feeler and grinding wheel may be as limited as possible.

Thirdly, when the grinding machine has a table of the reciprocating type, i.e. which moves linearly to-and-fro under the grinding wheel, the moving parts of the measuring head such as the feeler, the connecting piece between the feeler and the transducer, the moving part of the latter and the spring producing the measuring force, are subjected to positive and negative accelerations and to vibrations of the table, and this is another source of errors in the measurements.

SUMMARY OF INVENTION

An object of the invention is to provide automatic calibration equipment of the kind set forth which does not suffer from these drawbacks. To this end, according to the invention, the measuring head of said equipment comprises a pneumatic circuit having a first branch of very low internal volume provided with an inlet nozzle and a measuring outlet nozzle oriented to blow towards the edge of the grinding wheel, a second branch provided with an inlet nozzle and a reference outlet nozzle, means for connecting the inlet nozzles of these branches to an installation supplying compressed air at regulated pressure, and a pressure-differential transducer with a semi-conducting element for detecting the difference between the pressures in said branches and producing said electric output signal.

In this manner, the jet of air from the measurement nozzle does not wear the grinding wheel and as there is no longer any contact between the grinding wheel and the measuring head the latter is also not subjected to wear, either. Thus, compared to a mechanical measuring head, the measuring head according to the invention has the advantage that it is not subjected to wear and does not wear the grinding wheel.

Moreover, in the case of a reciprocating table, its accelerations and vibrations do not have a measurable effect on the abovementioned jet of air.

Further, as the measuring head no longer has movable parts liable to oscillate and resonate, the chips and grains from the grinding wheel no longer can have a deleterious effect on the measurements. Thus the measuring head according to the invention obviates inaccuracies in the measurements by mechanical measuring heads due to the projection of chips and grains from the grinding wheel.

In the automatic calibration equipment according to the invention, the measuring head preferably further comprises at least one cleaning nozzle also oriented to blow towards the edge of the grinding wheel for removing cooling liquid used for machining the workpieces from the location towards which the measurement nozzle blows, and means for delivering compressed air to this cleaning nozzle.

BRIEF DESCRIPTION OF THE DRAWINGS

The invention will be better understood from the following description of an embodiment selected as an example to illustrate it. This description refers to the accompanying drawings, given by way of example, in which.

DETAILED DESCRIPTION

Figure 1:
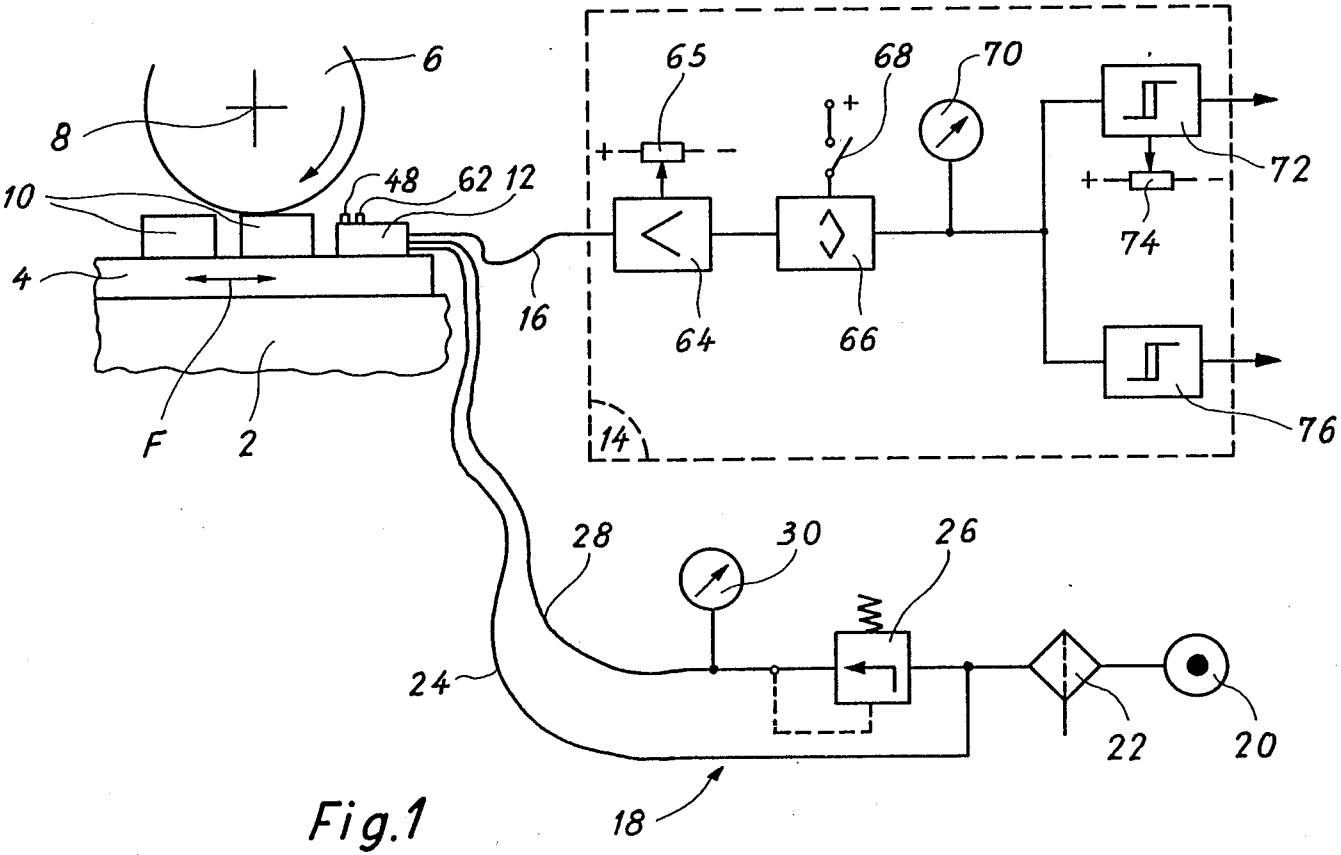
FIG. 1 diagrammatically and partially shows a planar grinding machine and associated automatic calibration equipment according to the invention.

The planar grinding machine shown partly and diagrammatically in FIG. 1 comprises a frame 2 which carries, for example with an intermediate film of oil, a horizontal reciprocating table 4 which is mounted on the frame 2 for a linear to-and-fro movement between two extreme positions in the direction of double-headed arrow F.

Above the table 4 is located a circular grinding wheel 6 rotatable about a horizontal axis 8, orthogonal to the direction of movement F of the table 4, and which is mounted on a support (not shown) so that it can be moved vertically and possibly parallel to the axis 8 for machining workpieces having a width greater than the thickness of the grinding wheel and/or several rows of workpieces arranged side by side.

FIG. 1 shows only two of these workpieces designated by reference 10 and which are situated at the end of a single row or several rows.

The automatic calibration equipment according to the invention which is also shown in this Figure comprises three parts: a measuring head 12 which is permanently or removably fixed to the table 4 of the grinding machine, for example by screwing, glueing or magnetically, in line with the row of workpieces 10 and in the field of action of the grinding wheel 6; an electronic measuring and control apparatus 14 described in detail below, and which is connected to the measuring head 12 by an electric cable 16; and an installation 18 for delivering compressed air to the head 12.

The installation 18 is made up principally of a source of compressed air 20 able to supply air at a pressure for example of 4 to 10 bars, a filter 22 at the outlet of source 20, a duct 24 which directly delivers a part of the air passing through filter 22 to the measuring head 12, a pressure regulator 26 which receives the rest of this air, another duct 28 which connects regulator 26 to the head 12 and a manometer 30 for indicating the pressure in conduit 28.

Figure 2:
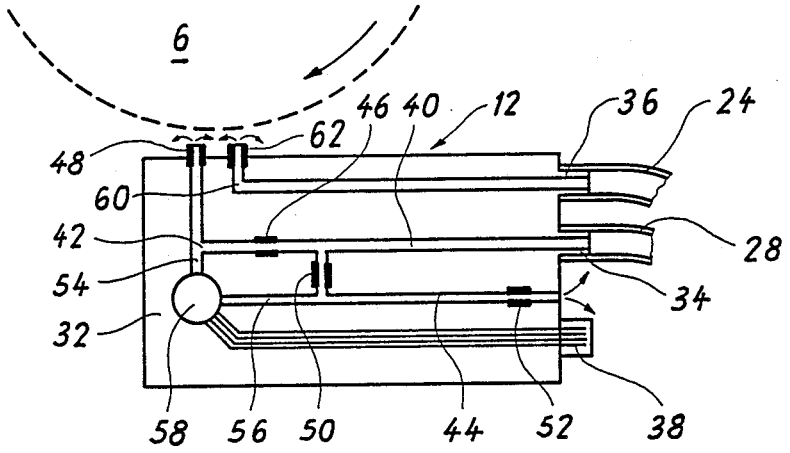
FIG. 2 is a diagrammatic view in longitudinal cross-section of the measuring head forming part of the equipment.

FIG. 2 diagrammatically shows how the measuring head 12 is made.

This head 12 comprises a body 32, for example parallelepipedic or cylindrical, having at one of its ends two nipples 34 and 36 to which are connected the abovementioned ducts 28, 24 respectively, and a terminal 38 for connecting the electric cable 16 (not shown in this Figure).

From the nipple 34 extends an internal duct 40 which is divided into two branches 42 and 44.

The first branch 42 extends between an inlet nozzle 46 and a measurement outlet nozzle 48 located on the side or on the periphery of the body 32 so as to be able to blow air onto the edge of the grinding wheel 6 when the head 12 is fixed on the table 4.

The second branch 44 extends between another inlet nozzle 50 and an adjustable outlet nozzle 52 used as reference.

As shown in FIG. 2, the second branch 44 leads out on the same side as the nipples 34 and 36. This location is evidently not essential, but what is essential is that the compressed air in branch 44 must always be able to escape freely.

It can be seen from FIG. 2 that each of the two branches 42 and 44 has an offshoot 54, 56 respectively. These offshoots 54, 56 lead to a differential pressure transducer 58 incorporating a semi-conductor element for measuring the pressure differential between the two branches 42, 44. Transducer 58 is electrically connected to the aforementioned connection terminal 38 so it can be supplied by the cable 16 and deliver the electric signal it produces via this cable.

The transducer 58 is basically made up of a semiconducting plate in which a membrane is formed by chemical machining processes, and a bridge of piezo-resistors formed on this membrane. Transducers of this type are now well known. Further information on their structure, operation and manufacture is available in French patent application No. 2 266 314.

Finally, FIG. 2 also shows that the head 12 has another internal duct 60 leading from the nipple 36 to another nozzle 62 located near the measurement nozzle 48 so that air from the nozzle 62 may drive cooling liquid such as oil on the edge of the grinding wheel away from the location towards which the measurement nozzle 48 blows at the moment when the grinding wheel 6 passes above it.

Generally, the position of a cleaning nozzle like nozzle 62 in relation to the measurement nozzle 48 depends evidently on the manner in which the head 12 is placed on the table 4, the position it occupies and the direction of rotation of the grinding wheel 6.

In the present example, the two nozzles 62 and 48 are substantially aligned lengthwise of the head 12, and the nozzle 62 is closer to the end where the nipples 34 and 36 are located, but it would be feasible to have the measurement nozzle 48 closer to this end. Also, if the measuring head 12 were transverse to the direction of movement of the table and not longitudinal as in FIG. 1, the cleaning nozzle 62 should be laterally offset in relation to the measurement nozzle 48.

It is noted that instead of a single cleaning nozzle, two or more could be arranged around the measurement nozzle.

While discussing the manner in which the head 12 is placed on the table 4, it should be noted that it is not necessary for the head to be located at the end of a or the row of workpieces 10. It could also be located beside or between the workpieces 10 and if these workpieces were too thin to allow the head to be placed on the table, the head could be attached to the lateral wall of the latter. The essential points are that the grinding wheel 6 passes above the head 12 or at least above the measurement nozzle and the cleaning nozzle(s) and that the ducts and the cable connecting the head 12 respectively to the compressed air supply installation 18 and to the electronic measuring and control apparatus 14 should not undergo too large deformations and risk causing or being subjected to damage during a machining operation.

The just-described measuring head operates in an analogous manner to the spindles or rings currently used for pneumatically measuring inner and outer diameters.

When there is nothing in front of the measurement nozzle 48, a constant stream of compressed air is freely released from it and if the transducer 58 is energized it produces a constant electric output signal representative of the algebraic value of the pressure differential between the branches 44 and 42 or 42 and 44, depending on how it is connected.

But when the grinding wheel 6 passes above the nozzle 48, there comes a time when the compressed air can only escape therefrom by moving radially outwards from its outlet orifice, as shown by the arrows in FIG. 2, and if the condition to be explained later is fulfilled the rate of flow,. of this air will be a function of the area of an imaginary annular surface located between the rim of this orifice and the edge of the grinding wheel and consequently the average distance between this rim and this edge.

In other words, the flow rate of the air issuing from the nozzle 48 decreases, goes through a minimum value when the axis of the grinding wheel 6 is located directly above the center of the opening of the nozzle 48 and then increases back to the value it had before passage of the grinding wheel.

Conversely, the pressure of air in the branch 42 and its offshoot 54 increases up to a maximum value which corresponds to the minimum value of the flow rate and then decreases.

Also, it is evident that the further the grinding wheel 6 advances the lower will be this minimum value of the flow rate and the greater will be the maximum value of the pressure.

Suppose firstly that the transducer 58 is connected so as to supply an output signal representing the difference of the pressure in the branch 44 and the pressure in branch 42. In these conditions, each time the grinding wheel 6 passes above the measurement nozzle 48 this output signal passes through a minimum value and the lower the grinding wheel 6 the lesser the minimum value will be.

Unlike the flow of air from the nozzle 48, this minimum value of the signal may in principle assume negative values. For this reason, it cannot always be said that this signal is representative of the distance between the grinding wheel and the table; but it is always a function thereof.

In practice, one will generally arrange in this instance to achieve the same result as with mechanical measuring heads used at present, namely adjusting the reference nozzle so that the pressures in the branches become substantially equal when the workpieces reach their final dimensions, and finely adjusting the zero of the output signal of the transducer by means of a potentiometer incorporated in the measuring and control apparatus to obtain a signal whose minimum values exactly represent the excess thickness of the workpieces in relation to these final dimensions.

Theoretically, it would also be possible to adjust the reference nozzle and the potentiometer so that the zero of the signal corresponds to a zero distance between the grinding wheel and the table whereby the minimum values obtained represent the nominal dimensions of the workpieces. But when grinding workpieces it is in general preferred to know the excess thickness and not the dimensions.

Suppose now that the transducer 58 is connected in a manner to supply an output signal representing the difference between the pressure in the branch 42 and the pressure in the branch 44.

In this case, this signal no longer goes through a minimum value when the grinding wheel 6 is located above the measurement nozzle 48 but instead goes through a maximum value the magnitude of which increases as the grinding wheel is lowered.

As will be seen later, it is easy to obtain the same information as in the previous case by slightly modifying the electronic circuit of the measuring and control apparatus.

In fact, for correct operation of the measuring head 12, as just indicated, two conditions must be fulfilled.

The first condition, which has already been alluded to, is that from the moment when measurements are to be taken, the area of the outlet orifice of the measurement nozzle 48 must be greater than the area of the smallest surface that may be located between the rim of this orifice and the edge of the grinding wheel 6, this smallest surface being of course that which is there when the axis of the grinding wheel 6 is directly above the center of the orifice 48.

If this is true to begin with, it is necessarily true when the grinding wheel 6 continues to advance.

This condition is entirely comparable with the condition that must be fulfilled when taking measurements of inner and outer diameters using the aforementioned spindles or rings. If this condition were not met, measurements would not be possible because the rate at which compressed air flows out of the nozzle 48 and the pressure in the branch 42 would not vary.

The second condition concerns a feature of the invention and is related to the fact that the horizontal movement of the table 4 and of the head 12 is very rapid. For reasons of clarity, this feature is not illustrated in the drawings.

This second condition is that the inner volume of the branch 42 and its offshoot 54 should be as small as possible or at least should not be above a given limit which is of the order of a few mm3.

Given that the diameter of the grinding wheel 6 is large, one can consider that at the moment when its axis passes above the measurement nozzle 48 the area of the imaginary surface included between its edge and the rim of the orifice of nozzle 48 remains constant for a given time. However, this time is very short and, for the measurement to be correct, it must be sufficient to allow the pressure in the branch 42 and its offshoot 54 to equalize.

Therefore, the smaller the volume of the branch and its offshoot, the quicker will be this pressure equalization.

The electronic measuring and control apparatus 14 shown in FIG. 1 and which corresponds to the first configuration of connection of the transducer 58 set out above will now be described.

This apparatus comprises firstly an amplifier circuit 64 receiving the output signal of the transducer 58 via two conductors of the cable 16, the other conductors of this cable being connected to a power supply, preferably a current source, not shown, and a potentiometer 65 for acting thereon to adjust the zero of the signal supplied by the transducer 58.

This circuit 64, whose gain must be positive, may be a simple differential amplifier or a more complex circuit. It could for example comprise a first operational amplifier which could be acted upon through the potentiometer 65 and a second operational amplifier connected after the first and which could be acted upon by means of another potentiometer to adjust the gain of the unit. A circuit of this type is described in U.S. Pat. No. 4 538 449.

The apparatus 14 also comprises an analog memory 66 for storing the minimum values of the signal supplied by the amplifier circuit 64, which correspond to those of the output signal of the transducer 58, and a switch 68 which enables this memory 66 to be connected to a positive terminal of the associated electronic circuit to re-initialize (reset) its content, more precisely to restore it to a given maximum value.

This switch 68 may for example be a key actuated switch that is manually actuated before grinding, new workpieces or may be a relay that is energized by the electric control means of the machine when the latter is started up to machine a series of workpieces.

It may also be a transistor that periodically receives, for example every ten seconds, impulses produced by an electronic oscillator that render it conducting.

Figure 3:
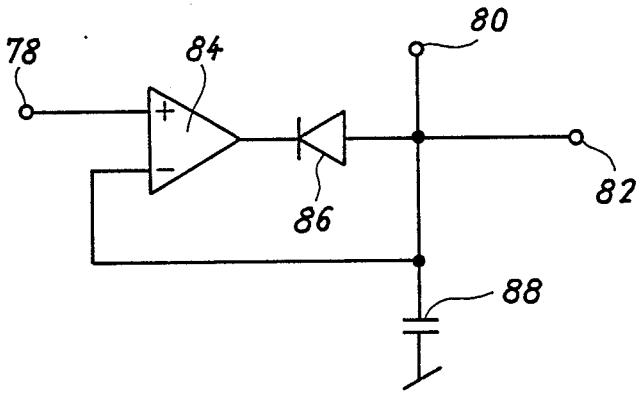
FIG. 3 is a diagram of a memory used in the electronic measuring and control apparatus and also forming part of the equipment.

FIG. 3 shows how the memory 66 is made.

This memory has two inputs 78 and 80 connected respectively to the output of the amplifier circuit 64 and to a terminal of the switch 68, and an output 82.

It is made up of an operational amplifier 84 whose non-inverting input is connected to the terminal 78, a diode 86 whose cathode is connected to the output of the amplifier 84 and whose anode is connected to terminals 80 and 82 as well as to the inverting input of amplifier 84, and a capacitor 88 connected between the anode of diode 86 and ground. Capacitor 88 constitutes the memory element and can be recharged by means of the switch 68.

Memories of this type are well known and, as is known, as long as they have not been re-initialized (reset) they can only memorize successively decreasing values.

Consequently, if the grinding wheel 6 passes above the measuring head 12 several times while remaining at the same level and if a minimum value of the signal supplied by the amplifier circuit 64 is slightly greater than the preceding value, this value is not memorized unless the capacitor 88 has been recharged in the meantime, which may be the case if it is periodically recharged.

Finally, FIG. 1 also shows a display device 70 connected to the output of the memory 66 and which indicates the excess thickness of the workpieces in relation to their final dimensions, and two Schmitt triggers 72 and 76 also connected to the output of memory 66.

The first of these triggers, 72, permanently compares the value stored in the memory 66 with a positive reference value that can be adjusted by means of a potentiometer 74, and generates a control signal which causes the grinding machine to proceed from the rough machining phase to the finishing phase when the workpieces have reached given dimensions corresponding to this reference value.

The second trigger 76 compares the memorized values with the value zero and produces a signal for controlling withdrawal of the grinding wheel 6 when the workpieces have reached their final dimensions.

Of course, in reality the measuring and control apparatus of a grinding machine is not as simple as that of FIG. 1, but it would be superfluous to describe all of the additional switching, adjusting and indicating means that are usually incorporated in such apparatus and are well known to persons skilled in the art.

Let us rather consider how the as-described apparatus can be adapted to the case when the transducer 58 of the measuring head 12 is connected to supply a signal representing the difference between the pressure in the branch 44 and that in the branch 42 (see FIG. 2).

A first solution consists simply in replacing the amplifier circuit 64 having a positive gain by an amplifier circuit having a negative gain, which enables the same memory 66 and the same switch 68 to be retained.

Another solution is to keep the same amplifier circuit 64, replace the memory 66 by an analog memory capable of storing maximum values, replace the switch 68 by a switch which allows this memory to be connected to ground and additionally provide an operational amplifier, for example with a gain of $-1$, for converting the memorized values into corresponding minimum values.

As is known, it is very easy to obtain a maximum-values memory from the memory shown in FIG. 3 simply by inverting the direction of connection of the diode 86.

Also, it is clear that the invention is not limited to the described embodiment and the modifications already envisaged.

It would indeed be possible to imagine for example another embodiment in which the reference nozzle would not be adjustable and in which the zero of the output signal of the measuring head could be adjusted only by one or two potentiometers incorporated in the measuring and control apparatus.

Additionally, the invention may also be applied to planar reciprocating-table grinding machines having a grinding wheel with a vertical axis instead of a horizontal one.

The invention may also be extended to planar grinding machines having a rotatable table but then it is necessary to provide for example rotary connectors and a collecting ring for respectively enabling compressed air delivery ducts and the cable which connects the measuring head to the electronic measuring and control apparatus to follow the movement of this table.

I claim:

1. In a planar grinding machine comprising a horizontal table for carrying workpieces and a grinding wheel arranged above this table, the grinding wheel having a grinding surface for machining said workpieces and being movable between an operative position for machining the workpieces and a retracted position, automatic calibration equipment comprising a measuring head fixed to the table for producing during machining of the workpieces an output signal that passes through an extreme value each time the grinding wheel passes above the measuring head, said extreme value being a function of the distance which separates the grinding wheel from the table at that instant, means for memorizing values which correspond to at least some of the successive values taken by the output signal of the measuring head and means for producing signals controlling movement of the grinding wheel between its operative position and retracted position when the memorized values correspond to reference values, wherein the measuring head comprises a pneumatic circuit having a first branch provided with an inlet nozzle and a measurement outlet nozzle oriented to blow a jet of air which impinges against said grinding surface of the grinding wheel when the grinding wheel is in its operative position and passes above the measuring head and a second branch provided with an inlet nozzle and a reference outlet nozzle, means for delivering compressed air at regulated pressure to the inlets of the first and second branches, and means for detecting a difference between the pressures in said first and second branches and producing said output signal, the area of an imaginary annular surface extending between said grinding surface and a rim of said measurement outlet nozzle being substantially constant for only a short time because of the speed of said grinding wheel passage, the first branch having an internal volume sufficiently small relative to the area of said imaginary annular surface and the speed of said grinding wheel passage that said impingement of the jet of air from the measurement nozzle against said grinding surface of the grinding wheel provides an equalized pressure in the first branch representative of the distance which separates the grinding wheel from the table, and the reference outlet of the second branch being arranged to allow air to escape freely to provide a reference pressure in the second branch.

2. Automatic calibration equipment according to claim 1, wherein said detecting means comprises a pressure-differential transducer with a semi-conductor element for detecting the difference between the pressures in said branches and producing said output signal, and the extreme values of the output signal produced by the transducer of the measuring head and the corresponding memorized values are minimum values.

3. Automatic calibration equipment according to claim 4, wherein the measuring head comprises at least one additional cleaning nozzle, also oriented to blow towards the grinding surface of the grinding wheel, for removing cooling liquid used to machine the workpieces from the location towards which the measurement outlet nozzle blows, and means for delivering compressed air to this cleaning nozzle.

4. Automatic calibration equipment according to claim 1, wherein said grinding surface is an annular edge around the periphery of said grinding wheel, and said grinding wheel passes above the measuring head in a plane of said annular edge.

5. Automatic calibration equipment according to claim 4, wherein said detecting means comprises a pressure-differential transducer with a semi-conductor element for detecting the difference between the pressures in said branches and producing said output signal, and the extreme values of the output signal produced by the transducer of the measuring head and the corresponding memorized values are minimum values.

6. Automatic calibration equipment according to claim 4, wherein the measuring head comprises at least one additional cleaning nozzle, also oriented to blow towards the grinding surface of the grinding wheel, for removing cooling liquid used to machine the workpieces from the location towards which the measurement outlet nozzle blows, and means for delivering compressed air to this cleaning nozzle.

7. Automatic calibration equipment for a planar grinding machine that comprises a horizontal table for carrying workpieces and a grinding wheel arranged above this table, the grinding wheel having an edge for machining said workpieces and being movable forward and backward for coming into contact with and moving away from the workpieces, which equipment comprises a measuring head fixed to the table for producing during machining of the workpieces an electric output signal that passes through an extreme value each time the grinding wheel passes above it, said extreme value being a function of the distance which separates the grinding wheel from the table at that instant, means for memorizing values which correspond to at least some of the successive values taken by the output signal of the measuring head, and means for producing signals controlling the forward and backward movement of the grinding wheel when the memorized values correspond to reference values, wherein the measuring head comprises a pneumatic circuit having a first branch of very low internal volume provided with an inlet nozzle and a measurement outlet nozzle oriented to blow towards the edge of the grinding wheel and a second branch provided with an inlet nozzle and a reference outlet nozzle, means for connecting the inlet nozzles of these branches to an installation delivering compressed air at regulated pressure, a pressure-differential transducer with a semiconductor element for detecting the difference between the pressures in said branches and producing said output signal, at least one additional cleaning nozzle, also oriented to blow towards the edge of the grinding wheel, for removing cooling liquid used to machine the workpieces from the location towards which the measurement outlet nozzle blows, and means for delivering compressed air to this cleaning nozzle.

8. Automatic calibration equipment according to claim 7, wherein the extreme values of the output signal produced by the transducer of the measuring head and the corresponding memorized values are minimum values.

9. Automatic calibration equipment according to claim 7, wherein said edge for machining said workpieces comprises the annular periphery of said grinding wheel, and said grinding wheel passes above said measuring head in a plane of said annular periphery.

* * * * *

UNITED STATES PATENT AND TRADEMARK OFFICE

CERTIFICATE OF CORRECTION

PATENT NO. : 4,912,884

DATED : April 3, 1990

INVENTOR(S) : Hans Sigg

It is certified that error appears in the above-identified patent and that said Letters Patent is hereby corrected as shown below:

Claim 3, line 2, change "4" to --1--.

Signed and Sealed this

Seventh Day of April, 1992

*Attest:*

HARRY F. MANBECK, JR.

*Attesting Officer*

*Commissioner of Patents and Trademarks*